United States Patent [19]

Pickens

[11] Patent Number: 4,521,283

[45] Date of Patent: Jun. 4, 1985

[54] ELECTRO ORGANIC METHOD AND APPARATUS FOR CARRYING OUT SAME

[75] Inventor: Stanley R. Pickens, Wadsworth, Ohio

[73] Assignee: PPG Industries, Inc., Pittsburgh, Pa.

[21] Appl. No.: 648,549

[22] Filed: Sep. 7, 1984

Related U.S. Application Data

[63] Continuation-in-part of Ser. No. 478,931, Mar. 25, 1983, Pat. No. 4,472,251.

[51] Int. Cl.[3] ..... C25C 1/00

[52] U.S. Cl. ..... 204/59 R; 204/72

[58] Field of Search ..... 204/59 R, 72

[56] References Cited

U.S. PATENT DOCUMENTS

| | | | |
|---|---|---|---|
| 3,427,234 | 2/1969 | Guthke | 204/283 |
| 4,053,402 | 10/1977 | Kastening | 204/59 R |
| 4,445,985 | 5/1984 | Korach | 204/59 R |

*Primary Examiner*—John F. Niebling

*Attorney, Agent, or Firm*—Bruce H. Cottrell

[57] ABSTRACT

Discloses electro-organic synthesis of organic sulfur compounds.

10 Claims, 3 Drawing Figures

ELECTRO ORGANIC METHOD AND APPARATUS FOR CARRYING OUT SAME

CROSS-REFERENCE TO RELATED APPLICATIONS

This application is a continuation-in-part of my application Ser. No. 478,931, filed Mar. 25, 1983, now U.S. Pat. No. 4,472,251.

BACKGROUND OF THE INVENTION

Electrolytic synthesis of organic compounds in an electrolytic cell has generally proven to be industrially unsatisfactory. This is because of the necessity of providing a current carrier, i.e., an ionizable molecule, to carry charge between the anode and the cathode. The organic reactants and products themselves generally will not perform this function because of their lack of ionic character.

One attempt at eliminating the requirement for a dissolved, ionized, or liquid current carrying supporting electrolyte is disclosed in U.S. Pat. No. 3,427,234 to Guthke et al. and Japanese Pat. No. 56/23290 to Yoshizawa et al., both of which describe the use of a solid polymer electrolyte electrolytic cell to carry out the electrolytic synthesis of organic compounds. In a solid polymer electrolyte electrolytic cell the anode is in contact with one surface of the solid polymer electrolyte and the cathode is in contact with the other surface of the solid polymer electrolyte. The solid polymer electrolyte itself is a polymeric material having pendant ionic groups which enhance the ionic conductivity of the underlying polymer matrix. Thus, negatively charged particles may flow from the cathode through the solid polymer electrolyte to the anode without ever contacting the organic media. Likewise, positively charged particles may travel from the anode through the solid polymer electrolyte to the cathode without ever contacting the organic media. In the electrolytic synthesis described in Guthke et al. and Yoshizawa et al., the cathodic and anodic reactions take place at an electrode-liquid organic reactant interface, a surface of the cathode and a surface of the anode each being in contact with the solid polymer electrolyte. Charged particles traverse the solid polymer electrolyte as described hereinabove.

However, providing a solid polymer electrolyte in contact with both the anode and the cathode does not, alone, result in an industrially useful electrolytic cell for electroorganic synthesis. For example, the typical prior art permionic membrane materials described in U.S. Pat. Nos. 3,041,317 to Gibbs, 3,718,617 to Grot, and 3,849,243 to Grot, 4,065,366 to Oda et al., 4,116,888 to Ukihashi et al. and 4,126,588 to Ukihashi et al., and 4,151,053 to Seko et al., require water of hydration. The combination of water of hydration and immobilized ionic sites bonded to the polymer provide ionic conductivity through the permionic membrane. In the absence of water of hydration, the electrical resistivity of the permionic membrane and, more particularly, the resistance to ionic transport of the permionic membrane, is objectionably high.

As organic media are typically non-aqueous, the aforementioned permionic membranes employed in such organic media are unable to attain or maintain an equilibrium content of water of hydration. Similarly, where the reaction medium is an anhydrous gas phase medium (the reactants and products also being anhydrous gases), the aforementioned permionic membrane materials are incapable of maintaining an equilibrium water of hydration content.

SUMMARY OF THE INVENTION

The present invention provides a method of electrolytically forming organic sulfur compounds selected from the groups consisting of sulfides, sulfoxides, sulfonic acids and sulfonyls in an electrolytic cell having an anode, a cathode and solid electrolyte means therebetween and in contact with the anode and the cathode. The method comprises contacting at least one of the anode and cathode with a gaseous sulfur compound selected from the group consisting of sulfur dioxide, sulfur trioxide, hydrogen sulfide, thionyl chloride and sulfuryl chloride, and a reducible organic compound selected from the group consisting of $C_2$ to $C_8$ olefins, $C_1$ to $C_6$ primary alcohols, $C_3$ to $C_6$ secondary alcohols, $C_4$ to $C_8$ tertiary alcohols, primary alkyl halides, secondary alkyl halides and aryl halides, and imposing an electric potential across the anode-cathode pair.

FIGURES

DETAILED DESCRIPTION OF THE INVENTION

The invention herein contemplated resides in a method of electrolytically synthesizing organic compounds. More particularly, the invention relates to solid electrolyte electrolytic methods for the essentially anhydrous electrolytic synthesis of compounds, especially organic compounds.

Figure 1:
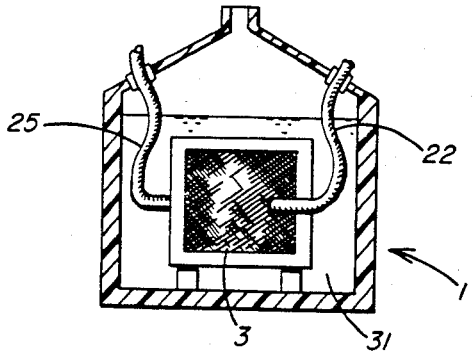
FIG. 1 is a cutaway front elevation of an electrolytic cell useful in one exemplification of the invention.
Figure 2:
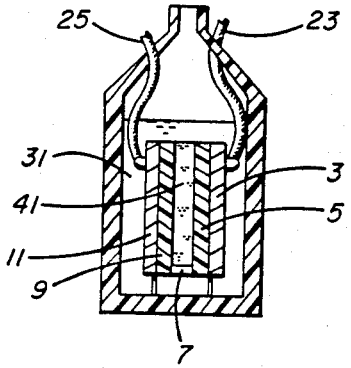
FIG. 2 is a cutaway side elevation of the electrolytic cell shown in FIG. 1.
Figure 3:
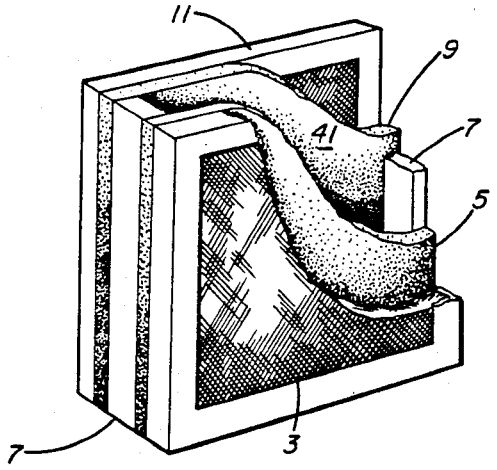
FIG. 3 is an isometric, partial cutaway, of the electrode-solid electrolyte-electrode assembly of the electrolytic cell shown in FIGS. 1 and 2.

According to one exemplification of the invention, gas phase organic reactions may be carried out. Gas phase organic electrolytic reactions present special problems because of the absence of water of hydration, polarizable liquids, or ionic liquids. As herein contemplated, gas phase organic reactions may be carried out by reacting an organic reactant at an electrode of an anode-cathode electrode pair to form an organic product. The method comprises contacting one member of the electrode pair, i.e., the anode-cathode pair, with the organic gaseous reactant or reactants while externally imposing an electrical potential across the electrode pair. Both electrodes of the electrode pair are in contact with solid electrolyte means therebetween, e.g., as shown in FIGS. 1 through 3, inclusive. The organic reactant or reactants should be gaseous under the condition of cell operation with the organic product being gaseous, liquid or solid.

More particularly, in distinction to fuel cell reactions, the contemplated reactions provide useful chemical products other than water or oxides of carbon. Moreover, the reactions require energy to be supplied to the system to form the product, i.e., by externally imposing an electrical potential across the anode and cathode.

An electrolytic cell structure for carrying out the method of this invention is shown in FIGS. 1, 2 and 3. As there shown, an electrolytic cell (1) has a structure of an anode (3), a solid electrolyte (5) in contact with the anode, a second solid electrolyte (9) in contact with the cathode (11), and a seal (7) between the two solid electrolyte portions (5) and (9). The structure defined by the anode side of the solid electrolyte portion (5), the cathode side of the solid electrolyte portion (9), and seal (7), can contain a highly ionizable material whereby ion transport is provided between the anode and cathode. Also shown in FIGS. 1 and 2 is an anode contact (23), cathode contact (25), and a unitary reaction medium (31) of reagent and reactant which may be in contact with both the anode and cathode. Optionally, the anode and cathode may be separated from each other by the solid electrolyte structure of solid electrolyte (5), seal (7), and solid electrolyte (9), with a separate anolyte containing compartment and catholyte containing compartment. The ionizable current carrier (41) is between the two portions (5) and (9) of the solid electrolyte, the anode (3), and the cathode (11).

While the anode-solid electrolyte-cathode is shown in the figures as an assembly of planar elements, it may also be an assembly that is of an open construction, i.e., to allow the organic medium to flow through the anode-solid electrolyte-cathode structure.

In a further exemplification of the method of this invention, which may utilize the above-described structure, a gaseous phase reaction may be carried out at either the anode or the cathode or both, by contacting the appropriate electrode or electrodes with the gas phase reactant or reactants in forming the gaseous, liquid or solid phase product or products. By gas phase reactant or product is meant a reactant or product that is gaseous at the temperatures and pressures within the electrolytic cell.

According to a preferred exemplification of the method of this invention, organic sulfur compounds, e.g., chosen from the group consisting of sulfides, sulfoxides, sulfonic acids and sulfonyls, may be electrolytically prepared in an electrolytic cell having an anode, a cathode, and the aforedescribed solid electrolyte means therebetween and in contact with the anode and the cathode. As herein contemplated, the organic sulfur compounds are formed by contacting either the cathode or the anode with a gaseous sulfur compound, e.g., $H_2S$, $SO_2$, $SO_3$, $SOCl_2$, $SO_2Cl_2$, or the like, and a gaseous or liquid organic compound. Exemplary organic compounds include olefins, e.g., $C_2$ to $C_8$ olefins, primary alcohols, e.g., $C_1$ to $C_6$ primary alcohols, secondary alcohols, e.g., $C_3$ to $C_6$ secondary alcohols, and tertiary alcohols, e.g., $C_4$ to $C_8$ tertiary alcohols. Additionally, organic halides, for example, primary and secondary alkyl and aryl chlorides, bromides and iodides may be reacted according to the method herein contemplated to form the organic sulfur compounds. Especially preferred organic reactants are $C_2$ to $C_6$ olefins, $C_1$ to $C_4$ primary alcohols, $C_3$ to $C_6$ secondary alcohols, $C_4$ to $C_8$ tertiary alcohols, and alkyl or aryl bromides and iodides having from 1 to 8 carbon atoms.

For example, sulfones can be produced at the cathode in the electrolytic cell by contacting sulfur dioxide and an alkyl halide. More preferably, the sulfur dioxide is contacted with an alkyl bromide or an alkyl iodide. The cathode compartment is filled with the desired alkyl halide. The anode compartment is filled with a solution of an oxidizable material in an ether. The oxidizable material should generate cations to pass through the membrane and should be readily soluble in the ether. The ether is preferably selected from those having boiling points in the range of 30° to 85° C. Among the suitable ethers are diethyl ether, diisopropyl ether, ethyl isobutyl ether, ethyl isopropyl ether, ethyl propyl ether, isobutyl methyl ether, isopropyl methyl ether, isopropyl propyl ether, methyl propyl ether, t-butyl methyl ether and tetrahydro- furan.

The oxidizable material can be a metal salt of a polyfunctional carboxylic acid, such as an alkali metal salt of a polyfunctional carboxylic acid, an ammonium salt of a polyfunctional carboxylic acid and a tetraalkylammonium salt of a polyfunctional carboxylic acid. The metal ion will pass through the solid electrolyte means from the anode compartment to the cathode compartment and will form the metal halide salt in the cathode compartment. An aprotic medium is generally desired when incorporating the $SO_2$ molecule into an organic moiety.

In a specific example, the cathode compartment is filled with a mixture of diethyl ether and ethyl iodide. The anode compartment is filled with a solution of lithium acetate in diethyl ether. When sulfur dioxide is continuously introduced in the vicinity of the cathode during electrolysis, diethylsulfone is produced.

In another example, a solution of dimethyl sulfone in dimethyl sulfoxide is placed within the cathode compartment. The anode compartment is filled with a solution of lithium acetate in diethyl ether. No sulfur dioxide is introduced to the cell during electrolysis. The controlled potential reduction of the dimethyl sulfone at the cathode produces dimethyl sulfoxide. In this example, the anode compartment can optionally be filled with protic oxidizable material such as aqueous hydrochloric acid. Aprotic comditions are not necessary or totally desirable in this example.

As described in U.S. Pat. No. 4,445,985 of M. Korach, gas phase reactions may be carried out at a lower voltage and higher efficiency by providing packing means in contact with one of the anode and cathode, and feeding the gaseous organic reactant to the electrolytic cell at a velocity high enough to induce turbulence therein while externally imposing an electrical potential across the anode and cathode.

In accordance with the present invention ionic mobility can be supplied by providing ionic means within the solid polymer electrolyte structure itself. Examples of such ionic means within the solid polymer electrolyte structure include, e.g., entrapped but mobile ionic means such as a strong electrolyte, the presence of an aqueous electrolyte in a solid polymer electrolyte structure having hydrophobic boundaries, whereby to maintain the aqueous electrolyte therein, or the presence of polar, ionic organic moieties within the permionic membrane or solid electrolyte with means for retaining the moieties therein.

Moreover, when such means are provided within the solid polymer electrolyte, electroorganic or other nonaqueous reactions may be carried out in either a divided cell, i.e., a cell where a solid polymer electrolyte, or permionic membrane divides the cell into anode and cathode compartments, or in electrolytic cells where the reaction medium, i.e., the reactants, products, and any other materials are present in one unitary medium containing both the anode and the cathode. Thus, it is further contemplated to utilize a solid polymer electrolyte in an electrolytic cell where the anode and cathode are in contact with essentially the same reaction medium, the external surfaces of the anode and cathode being in contact with the reaction medium, and other surfaces, e.g., the internal surfaces of the anode and cathode, being in contact with a solid polymer electrolyte, permionic membrane as described in the commonly assigned, copending application of N. R. DeLue and S. R. Pickens, for *Electro Organic Method And Apparatus For Carrying Out Same,* U.S. Ser. No. 478,928. In this way, the reactions principally occur at a site on the cathode or anode which is not embedded in the solid electrolyte. That is, the reactions principally occur at the external surfaces of the respective electrodes, i.e., at the interfaces of the respective electrodes with the reaction medium, while ionic transport is through the solid electrolyte. The contemplated structure may be used with either liquid or gaseous reactants and products.

The solid electrolyte itself may be an inorganic material as a crystalline inorganic material, a solid polymer electrolyte, or a solid polymer electrolyte or inorganic material comprised of multiple zones having a highly ionizable current carrier therein.

The electrodes may be removably in contact with the external surfaces of the solid electrolyte, bonded to external surfaces of the solid electrolyte, or bonded to and embedded in the solid electrolyte. The electrocatalyst may independently be covalently bonded to reactive ligands which ligands are in contact with, bonded to, or reactive with the solid polymer electrolyte.

As herein contemplated the supporting electrolyte and polar solvents normally required in the prior art may be substantially reduced or even eliminated. This results in a product of higher purity, greater ease of separation, fewer side reactions, and more constant potential. Moreover, this invention permits greater choice in the selection of the organic solvent, without regard to the presence or absence of a supporting electrolyte.

As described hereinabove, the solid electrolyte contains means for transporting ions therethrough. This is especially significant in processes involving non-aqueous media, such as organic media. By non-aqueous is meant that the behavior of the media of reactant and/or product is substantially that of a non-ionizable organic material, incapable of carrying charge at industrially feasible voltages. That is, the reactant and product medium functions as an insulator or dielectric rather than as a conductor. By non-aqueous media is meant a substantially or essentially anhydrous media.

The non-aqueous medium is not necessarily electrolyzed. It may simply serve as a solvent or diluent for the product or reactant. In the method herein contemplated, utilizing the above-described structure, the reagent is electrolyzed at an electrode means where the anode is in contact with one surface of the solid electrolyte means and the cathode is in contact with the opposite surface of the solid electrolyte means. As herein contemplated, the non-aqueous medium containing an organic reactant is provided in contact with one or both of the anode and cathode and an electrical potential is externally imposed across the anode and cathode so as to evolve product at an anode or a cathode or both and transport ionic species across the solid electrolyte means.

The permionic membrane interposed between the anode and the cathode may be formed of a polymeric fluorocarbon copolymer having immobile, cation selective ion exchange groups on a halocarbon backbone. The membrane may be from about 2 to about 25 mils thick, although thicker or thinner permionic membranes may be utilized. The permionic membrane may be a laminate of two or more membrane sheets. It may, additionally, have an internal reinforcing structure.

As herein contemplated, when a perfluorinated, cation selective permionic membrane is used, it is preferably a copolymer which may have:

(I) fluorovinyl ether acid moieties derived from $$CF_2{=}CF{-}O{-}[(CF_2)_b(CX'X'')_c(CFX')_d(CF_2{-}O{-}CX'X')_e(CX'X''{-}O{-}CF_2)_f]{-}A,$$

where b, c, d, e, and f are integers from 0 to 6, X, X′ and X″ are —F and $-(CF_2)_gCF_3$, g is 1 to 5, [] is a discretionary arrangement of the moieties therein, and A is a pendent ion exchange group described hereinafter, exemplified by:

$$CF_2{=}CFOCF_2CF(CF_3)OCF_2CF_2CF_2COOCH_3,$$

$$CF_2{=}CFO(CF_2)_3O\underset{\underset{CF_3}{|}}{C}FCOOCH_3,$$

$$CF_2{=}CFO(CF_2)_4O\underset{\underset{CF_3}{|}}{C}FCOOCH_3,$$

$$CF_2{=}CFOCF_2\underset{\underset{CF_3}{|}}{C}FCF_2COOCH_3, \text{ and}$$

$$CF_2{=}CFOCF_2CF(CF_3)OCF(COOCH_3)CF_3, \text{ inter alia;}$$

(II) fluorovinyl moieties derived from $$CF_2{=}CF{-}(0)_a{-}(CFX')_d{-}A,$$

where a is 0 or 1 and d is an integer from 0 to 6, exemplified by $$CF_2{=}CF(CF_2)_{2\text{-}4}COOCH_3,$$

$$CF_2{=}CF(CF_2)_{2\text{-}4}COOC_2H_5,$$

$$CF_2{=}CF(CF_2)_{2\text{-}4}COOH,$$

$$CF_2{=}CFO(CF_2)_{2\text{-}4}COOCH_3,$$

$$CF_2{=}CFO(CF_2)_{2\text{-}4}COOC_2H_5, \text{ and}$$

$$CF_2{=}CFO(CF_2)_{2\text{-}4}COOH, \text{ inter alia;}$$

(III) fluorinated olefin moieties derived from $$CF_2{=}CXX'$$

as exemplified by tetrafluoroethylene, dichlorodifluoroethylene, chlorotrifluoroethylene, hexafluoropropylene, trifluoroethylene, vinylidene fluoride, and the like; and (IV) vinyl ethers derived from $$CF_2{=}CFOR_4$$

where $R_4$ is a perfluoroalkyl group having from 1 to 6 carbon atoms.

The functional ion exchange group of the permionic membrane, A, may be a cation selective group. It may be a sulfonic group, a phosphoric group, a phosphonic group, a carboxylic group, or a reaction product thereof, e.g., an ester thereof. Thus, as herein contemplated, A in the structural formulas shown above is chosen from the group consisting of: —COOH, —$COOR_1$, —COOM, —COF, —COCl, —CN, —$CONR_2R_3$, —$SO_3H$, —$SO_2F$, —$SO_2Cl$, and —$SO_2NH_2$, where $R_1$ is a $C_1$ to $C_{10}$ alkyl group, $R_2$ and $R_3$ are hydrogen or $C_1$ to $C_{10}$ alkyl groups, and M is an alkali metal or a quaternary ammonium group. According to a preferred exemplification, A is: —COCl, —COOH, —$COOR_1$, —$SO_2F$, —$SO_2Cl$, —$SO_2NH_2$ where $R_1$ is a $C_1$ to $C_5$ alkyl.

The cation selective membrane need not be perfluorinated. Cation selective membranes may be made from resins prepared, for example, by the copolymerization of styrene, divinylbenzene and an unsaturated acid, ester, or anhydride, such as acrylic acid, methacrylic acid, methyl methacrylate, methyl acrylate, maleic anhydride, or the like. Other resins useful in forming cation selective membranes may be prepared, for example, from polymers or copolymers of unsaturated acids or their precursors, such as unsaturated acids or nitriles, or by the introduction of acid functional groups into cross-linked, non-perfluorinated polymers such as polyolefins, polyethers, polyamides, polyesters, polycarbonates, polyurethanes, polyethers, or poly(phenol formaldehydes) by means of reaction with a sulfonating, carboxylating, or phosphorylating reagent.

Alternatively, the ion exchange group, A, may be an anion selective group, such as a quaternary ammonium group, a primary amine group, a secondary amine group, or a tertiary amine group. Exemplary anion selective permionic membranes include ammonium derivates of styrene and styrene-divinyl benzene polymers or copolymers, amine derivatives of styrene and styrene-divinyl benzene polymers or copolymers, condensation polymers of alkyl oxides, e.g., ethylene oxides or epichlorohydrin with amines or ammonia, ammoniated condensation products of phenol and formaldehyde, the amine derivatives of acrylic and methacrylic ester polymers or copolymers, iminodiacetate derivatives of styrene and styrene-divinylbenzene polymers or copolymers.

A useful permionic membrane herein contemplated has an ion exchange capacity of from about 0.5 to about 2.0 milliequivalents per gram (meq/g) of dry polymer, preferably from about 0.9 to about 1.8 meq/g of dry polymer, and in a particularly preferred exemplification, from about 1.0 to about 1.6 meq/g of dry polymer. A useful perfluorinated permionic membrane herein contemplated may have, in the ester form, a volumetric flow rate of 100 cubic millimeters per second at a temperature of 150° to 300° degrees Centigrade (° C.), and preferably at a temperature between 160° to 250° C. The glass transition temperatures of such permionic membrane polymers are desirably below 70° C., and preferably below about 50° C.

The permionic membrane herein contemplated may be prepared by the methods described in U.S. Pat. No. 4,126,588, the disclosure of which is incorporated herein by reference.

Most commonly the ion exchange resins will be in a thermoplastic form, such as, a carboxylic acid ester, e.g., a carboxylic acid ester of methyl, ethyl, propyl, isopropyl, or butyl alcohol, or a sulfonyl halide, e.g., sulfonyl chloride or sulfonyl fluoride, during fabrication, and can thereafter be hydrolyzed.

When the solid electrolyte is a solid polymer electrolyte composed of a hydraed polymeric gel, as described above, it is essential to provide or retain water of hydration therein as described in the commonly assigned patent of M. Korach, referred to hereinabove. This may be accomplished by adding moisture, i.e., water vapor to at least one side of the anode-cathode pair. In this way the polymeric ion exchange resin membrane is maintained hydrated.

According to another exemplification, the permionic membrane useful in carrying out this invention may have a porous, gas and liquid permeable, non-electrode layer bonded to either the anodic surface, or the cathodic surface, or both the anodic and cathodic surfaces thereof, as described in British Laid Open Patent Application 2,064,586 of Oda et al. As described by Oda et al., the porous, non-catalytic, gas and electrolyte permeable, non-electrode layer does not have a catalytic action for the electrode reaction, and does not act as an electrode.

The porous, non-electrode layer is formed of either a hydrophobic or a non-hydrophobic material, either organic or inorganic. As disclosed by Oda et al., the non-electrode material may be electrically non-conductive. That is, it may have an electrical resistivity above 0.1 ohm-centimeter, or even above 1 ohm-centimeter. Alternatively, the porous, non-electrode layer may be formed of an electrically conductive material having a higher overvoltage than the electrode material placed outside the porous, non-electrode layer, i.e., the porous, non-electrode layer may be formed of an electrically conductive material that is less electrocatalytic than the electrode material placed outside the porous, non-electrode layer. The electrodes (3), (11), bear upon the porous, non-electrode surface.

The non-electrode material in the porous, non-electrode layer is preferably a metal, metal oxide, metal hydroxide, metal nitride, metal carbide, or metal boride of a Group IVA metal, e.g., Si, Ge, Sn, or Pb, a Group IVB metal, e.g., Ti, Zr, or Hf, a Group V-B metal, e.g., V, Nb, or Ta, a Group VIB metal, e.g., Cr. Mo, or W, or a Group VIII "Iron Triad" metal, Fe, Co, or Ni. Especially preferred non-electrode materials are Fe, Ti, Ni, Zr, Ta, V, and Sn, and the oxides, hydroxides, borides, carbides, and nitrides thereof, as well as mixtures thereof. Such material may have hydrophobic coatings thereon. For example, such materials may have hydrophobic coatings on at least a portion thereof whereby to exhibit hydrophobic and non-hydrophobic zones. Alternatively, the film, coating, or layer may be formed of a perfluorocarbon polymer as such or rendered suitably hydrophilic, i.e., by the addition of a mineral, as potassium titanate.

The non-electrode material is present in the porous film, coating, or layer as a particulate. The particles have a size range of from about 0.01 micron to about 300 microns, and preferably of from about 0.1 to 100 microns. The loading of particles is from about 0.01 to about 30 milligrams per square centimeter, and preferably from about 0.1 to about 15 milligrams per square centimeter.

The porous film, coating or layer has a porosity of from about 10 percent to 99 percent, preferably from about 25 to 95 percent, and in a particularly preferred exemplification from about 40 to 90 percent.

The porous film, coating or layer is from about 0.01 to about 200 microns thick, preferably from about 0.1 to about 100 microns thick, and in a particularly preferred embodiment, from about 1 to 50 microns thick.

When the particles are not directly bonded to and embedded in the permionic membrane a binder is used to provide adhesion. The binder may be a fluorocarbon polymer, preferably a perfluorocarbon polymer, such as polytetrafluoroethylene, polyhexafluoropropylene, or a perfluoroalkoxy, or a copolymer thereof with an olefinically unsaturated perfluorinated acid, e.g., having sulfonic or carboxylic functionality.

In an electrolytic cell environment where perfluorinated polymers are not required, the binder may be a hydrocarbon polymer such as a polymer or copolymer of ethylene, propylene, butylene, butadiene, styrene, divinylbenzene, acrylonitrile, or the like. Other polymeric materials such as polyethers, polyesters, polyamides, polyurethanes, polycarbonates, and the like may be employed. Such polymeric binding agents may also have acidic or basic functionality.

Various electrode structures may be utilized herein. For example, the electrode may be adhered to the solid electrolyte, as a film, coating, or layer thereon, either with or without hydrophilic or hydrophobic additives. Alternatively, the electrodes may be on separate catalyst carriers which removably bear on the solid electrolyte. Suitable electrocatalyst materials depend upon the particular reaction to be catalyzed, and may typically include transition metals, oxides of transition metals, semi-conductors, and oxygen deficient crystalline materials. Alternatively, such materials as transition metals having "d" subshell or orbital activity may be utilized, e.g., iron, cobalt, nickel, and the platinum group metals.

According to a still further exemplification of this invention, the electrode, i.e., the electrocatalyst in contact with the ion selective solid electrolyte may be chemically bonded thereto, e.g., by polydentate ligands. Thus, the solid electrolyte may have ion selective groups, e.g., cation or anion selective groups as well as having, e.g., carboxyl linkages to transition metal ions.

Various reactions may be carried out according to the method of this invention. For example, organic compounds may be reduced at the cathode or oxidized at the anode.

I claim:

1. A method of electrolytically forming organic sulfur compounds selected from the group consisting of sulfides, sulfoxides, sulfonic acids and sulfonyls in an electrolytic cell having an anode, a cathode, and solid electrolyte means or solid electrolyte means having a porus non-electrode layer on said solid electrolyte means therebetween and in contact with the anode and the cathode, comprising contacting at least one of said anode and cathode with a gaseous sulfur compound selected from the group consisting of sulfur dioxide, sulfur trioxide, hydrogen sulfide, thionyl chloride and sulfuryl chloride, and a reducible organic compound selected from the group consisting of olefins having from 2 to 8 carbons, primary alcohols having from 1 to 6 carbons, secondary alcohols having from 3 to 6 carbons, tertiary alcohols having from 4 to 8 carbons, primary alkyl halides, secondary alkyl halides and aryl halides and imposing an electrical potential from the anode to the cathode.

2. The method of claim 1 wherein the gaseous sulfur compound is sulfur dioxide.

3. The method of claim 1 wherein the reaction is a cathodic reaction.

4. The method of claim 1 wherein the reducible organic compound is selected from the group consisting of olefins having from 2 to 6 carbons.

5. The method of claim 1 wherein the reducible organic compound is selected from the group consisting of primary alcohols having 1 to 4 carbons, secondary alcohols having 3 to 6 carbons and tertiary alcohols having 4 to 8 carbons.

6. The method of claim 1 wherein the reducible organic compound is selected from the group consisting of primary alkyl halides, secondary alkyl halides and aryl halides each having from 1 to 8 carbons.

7. The method of claim 2 wherein the reducible organic compound is selected from the group consisting of primary alkyl halides, secondary alkyl halides and aryl halides each having from 1 to 8 carbons.

8. A method of electrolytically forming sulfones in an electrolytic cell having an anode, a cathode, and solid electrolyte means or solid electrolyte means having a porous non-electrode layer on said solid electrolyte means therebetween and in contact with the anode and the cathode, comprising contacting at least one of said anode and cathode with sulfur dioxide and a reducible organic compound selected from the group consisting of primary alkyl halides, secondary alkyl halides and aryl halides and imposing an electrical potential from the anode to the cathode.

9. The method of claim 8 wherein the reducible organic compound selected from the group consisting of primary alkyl halides, secondary alkyl halides and aryl halides contains from 1 to 8 carbons.

10. The method of claim 8 wherein the reducible organic compound is a primary alkyl halide having from 1 to 8 carbons.

* * * * *